US011808271B2

(12) United States Patent
Yamazaki

(10) Patent No.: US 11,808,271 B2
(45) Date of Patent: Nov. 7, 2023

(54) AXIAL FAN

(71) Applicant: SANYO DENKI CO., LTD., Tokyo (JP)

(72) Inventor: Yoshihisa Yamazaki, Tokyo (JP)

(73) Assignee: SANYO DENKI CO., LTD., Tokyo (JP)

( * ) Notice: Subject to any disclaimer, the term of this patent is extended or adjusted under 35 U.S.C. 154(b) by 0 days.

(21) Appl. No.: 17/879,491

(22) Filed: Aug. 2, 2022

(65) Prior Publication Data

US 2023/0072211 A1 Mar. 9, 2023

(30) Foreign Application Priority Data

Sep. 8, 2021 (JP) ..... 2021-146167

(51) Int. Cl.
*F04D 19/00* (2006.01)
*F04D 29/52* (2006.01)

(52) U.S. Cl.
CPC ..... *F04D 19/002* (2013.01); *F04D 29/522* (2013.01)

(58) Field of Classification Search
CPC ..... F04D 29/325; F04D 19/002
See application file for complete search history.

(56) References Cited

U.S. PATENT DOCUMENTS

2018/0195526 A1* 7/2018 Hakozaki ..... F04D 29/34
2020/0116162 A1* 4/2020 Shimada ..... F04D 25/082

FOREIGN PATENT DOCUMENTS

CN 204267319 U * 4/2015
JP 11-210700 A 8/1999

OTHER PUBLICATIONS

CN-204267319-U English Translation (Year: 2015).*

* cited by examiner

*Primary Examiner* — Anthony Ayala Delgado
(74) *Attorney, Agent, or Firm* — Rankin, Hill & Clark LLP

(57) ABSTRACT

Provided is an axial fan including: a rotor blade; a base portion placed on a rotation axis of the rotor blade and on a downstream side in an air-blowing direction of the rotor blade; and an outer frame portion where the rotor blade and the base portion are housed, wherein the base portion includes an inclined portion in an end portion, on the downstream side in the air-blowing direction, of the base portion, the inclined portion reducing in diameter toward the downstream side in the air-blowing direction, the inclined portion includes opening portions and hollow ribs, the opening portions are placed at predetermined intervals in a peripheral direction of the inclined portion, and each of the hollow ribs surrounds a peripheral part on an outer side of each of the opening portions, sticking out from the inclined portion toward the downstream side in the air-blowing direction along the rotation axis.

5 Claims, 3 Drawing Sheets

AXIAL FAN

CROSS-REFERENCE TO RELATED APPLICATION

This application is based on Japanese Patent Application No. 2021-146167 filed with the Japan Patent Office on Sep. 8, 2021, the entire content of which is hereby incorporated by reference.

BACKGROUND

1. Technical Field

The present disclosure relates to an axial fan.

2. Related Art

A fan configured in such a manner as to restrain an increase in the temperature of an electronic component of a circuit board placed in a stator frame is known from, for example, JP-A-11-210700. According to the fan of JP-A-11-210700, a first axial through-hole is formed on the radially inner side of a bottom portion of the stator frame. A second axial through-hole is formed on the radially outer side. Air that has flowed into the stator frame through the first axial through-hole flows along the surface of the circuit board, and then flows to the outside through the second axial through-hole. As a result, the electronic component is cooled.

SUMMARY

An axial fan according to the present embodiment includes: a rotor blade configured to rotate about a rotation axis along an air-blowing direction; a round tubular base portion placed on the rotation axis and on a downstream side in the air-blowing direction of the rotor blade; and an outer frame portion where the rotor blade and the base portion are housed. The base portion includes an inclined portion in an end portion, on the downstream side in the air-blowing direction, of the base portion, the inclined portion reducing in diameter toward the downstream side in the air-blowing direction. The inclined portion includes opening portions and hollow ribs. The opening portions are placed at predetermined intervals in a peripheral direction of the inclined portion. Each of the hollow ribs surrounds a peripheral part on an outer side of each of the opening portions in a radial direction of the inclined portion, and sticks out from the inclined portion toward the downstream side in the air-blowing direction along the rotation axis.

DETAILED DESCRIPTION

Figure 1:
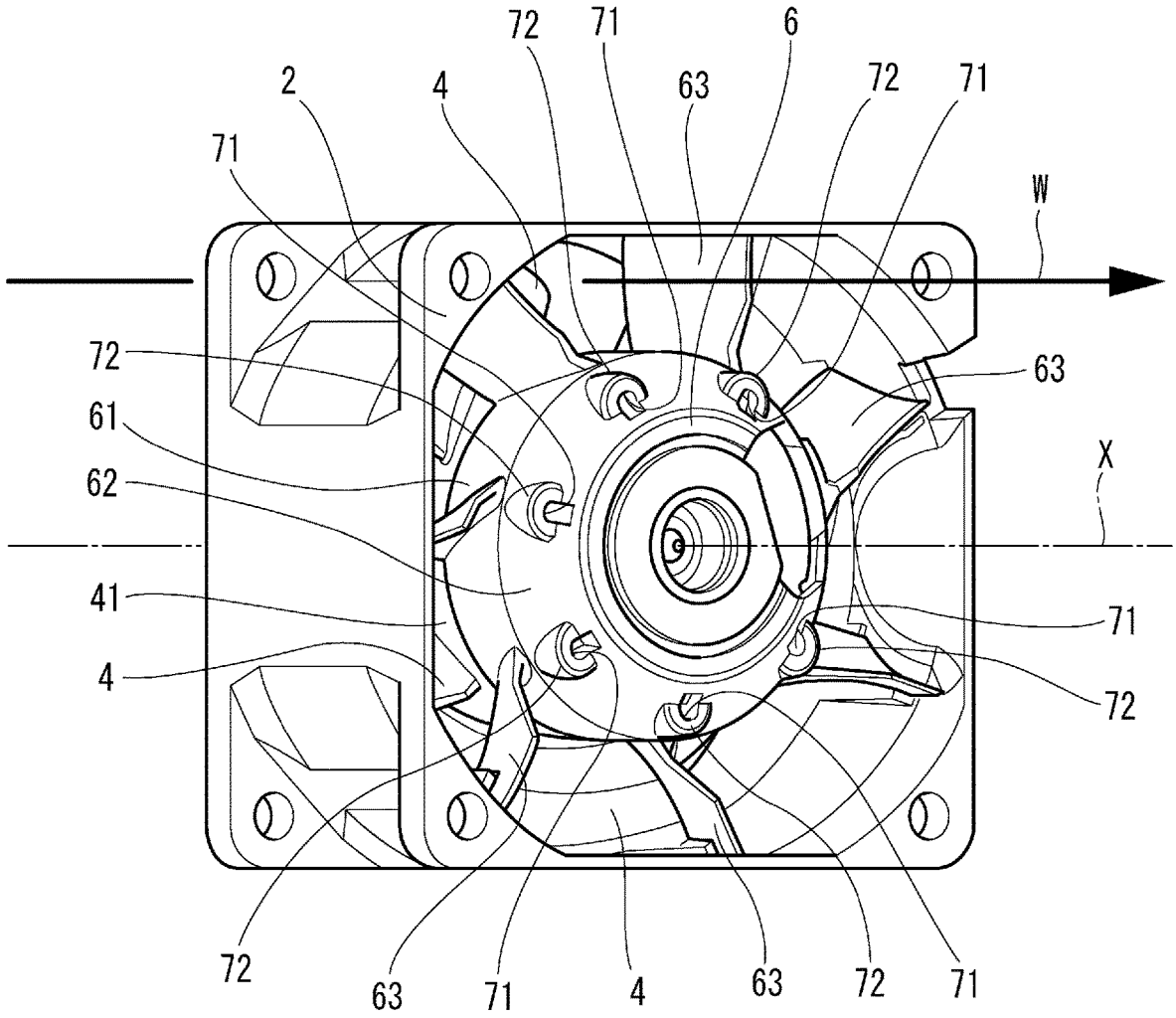
FIG. 1 is a perspective view of an axial fan according to an embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In the case of the fan disclosed in JP-A-11-210700, however, the first and second axial through-holes help circulate the air in the stator frame. As a result, the electronic component can be cooled. However, consideration is not given to the fact that the static pressure performance of the fan reduces due to the formation of the first and second axial through-holes in the bottom portion of the stator frame.

Hence, an object of the present disclosure is to provide an axial fan that can restrain an increase in the temperature of an internal component even under high load without reducing the performance of the fan.

An axial fan according to one aspect of the present embodiment includes: a rotor blade configured to rotate about a rotation axis along an air-blowing direction; a round tubular base portion placed on the rotation axis and on a downstream side in the air-blowing direction of the rotor blade; and an outer frame portion where the rotor blade and the base portion are housed. The base portion includes an inclined portion in an end portion, on the downstream side in the air-blowing direction, of the base portion, the inclined portion reducing in diameter toward the downstream side in the air-blowing direction. The inclined portion includes opening portions and hollow ribs. The opening portions are placed at predetermined intervals in a peripheral direction of the inclined portion. Each of the hollow ribs surrounds a peripheral part on an outer side of each of the opening portions in a radial direction of the inclined portion, and sticks out from the inclined portion toward the downstream side in the air-blowing direction along the rotation axis.

According to the present disclosure, it is possible to provide an axial fan that can restrain an increase in the temperature of an internal component even under high load without reducing the performance of the fan.

An embodiment of the present disclosure is described hereinafter with reference to the drawings. Descriptions of members having the same reference numerals as members already described in the detailed description are omitted for the sake of convenience. Moreover, the dimensions of each member illustrated in the drawings may be different from actual dimensions thereof for the convenience of description.

Figure 2:
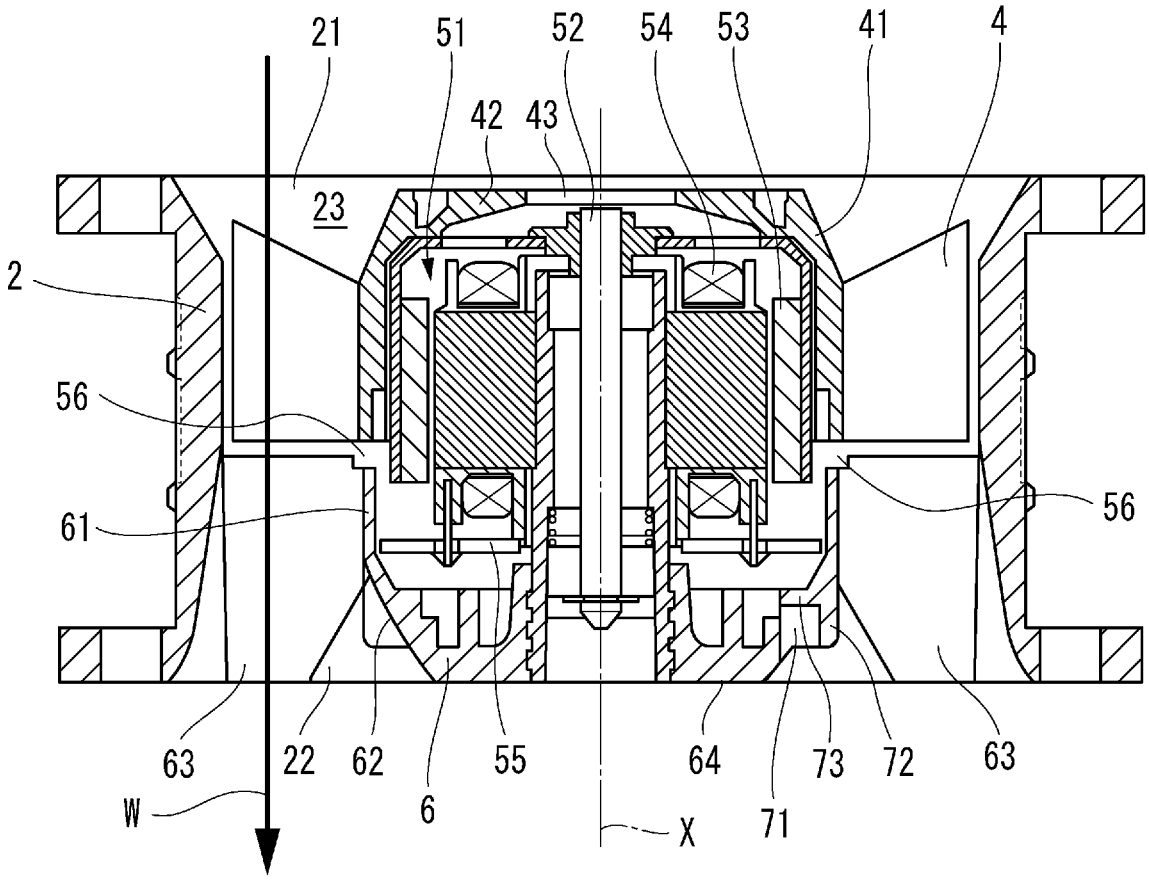
FIG. 2 is a cross-sectional view of the axial fan illustrated in FIG. 1.

FIG. 1 is a perspective view of an axial fan 1 according to the embodiment of the present disclosure. FIG. 2 is a cross-sectional view, along an air-blowing direction W, of the axial fan 1 illustrated in FIG. 1. As illustrated in FIGS. 1 and 2, the axial fan 1 includes an outer frame portion 2, and rotor blades 4 and a base portion 6, which are housed in the outer frame portion 2. The rotor blades 4 are placed upstream in the air-blowing direction W of the base portion 6 in the outer frame portion 2. In other words, the base portion 6 is placed downstream in the air-blowing direction W of the rotor blades 4.

The outer frame portion 2 defines a cylindrical wind tunnel space 23 communicating with an inlet 21 and an outlet 22 for wind (air). The rotor blades 4 and the base portion 6 are housed in the wind tunnel space 23. The wind that has been drawn in through the inlet 21 with the rotation of the rotor blades 4 is delivered in the air-blowing direction W along the wind tunnel space 23, and sent to the outside through the outlet 22.

The rotor blades 4 are attached to an outer peripheral surface of a rotor blade case 41. The rotor blade case 41 is formed in a cup shape. The plurality of (five in the illustrated example) rotor blades 4 is attached at regular intervals to the perimeter of the rotor blade case 41. The rotor blade case 41 is placed in such a manner that an opening portion thereof faces downstream in the air-blowing direction W. An opening 43 through which outside air can flow into the rotor blade case 41 is provided in a bottom wall 42 of the rotor blade case 41 that is located upstream in the air-blowing direction W.

A motor 51 is housed in the rotor blade case 41. The motor 51 includes a rotating shaft 52, a rotor 53 having a permanent magnet, and a wire wound stator 54. The rotor blade case 41 is fixed to the rotating shaft 52 of the motor 51. The permanent magnet of the rotor 53 is fixed to an inner peripheral surface of the rotor blade case 41. The rotor blades 4 attached to the rotor blade case 41 rotate about a rotation axis X with the rotation of the rotating shaft 52.

The base portion 6 is formed in a round tube shape, and placed in such a manner that an opening portion thereof faces upstream in the air-blowing direction W. Moreover, the base portion 6 is placed along the rotation axis X in a radially central part of the wind tunnel space 23 of the outer frame portion 2. The base portion 6 is provided in such a manner as to orient the opening portion thereof toward the opening portion of the rotor blade case 41 and in such a manner as to cover the opening portion of the rotor blade case 41.

The base portion 6 includes a round tubular portion 61, and an inclined portion 62 continuous with the round tubular portion 61. The round tubular portion 61 is provided upstream in the air-blowing direction W, and is formed in a round tube shape having a uniform diameter. The inclined portion 62 is provided downstream in the air-blowing direction W. Furthermore, the inclined portion 62 is tapered in such a manner as to reduce in diameter toward the downstream side in the air-blowing direction W, that is to say, toward the outlet 22 of the outer frame portion 2.

A part, on the downstream side in the air-blowing direction W, of the above-mentioned motor 51 is housed in the base portion 6. The stator 54 of the motor 51 is fixed to the base portion 6. Furthermore, a circuit board 55 is housed in the base portion 6. For example, electronic components for controlling the operation of the axial fan 1 are mounted on the circuit board 55. The circuit board 55 is fixed to the stator 54 of the motor 51. The circuit board 55 is fixed in such a manner that board surfaces on which, for example, the electronic components are mounted face downstream and upstream in the air-blowing direction W.

The base portion 6 is fixed to the outer frame portion 2 via fixed blades 63. The fixed blades 63 are stator blades for coupling the base portion 6 to the outer frame portion 2. In the illustrated example, seven fixed blades 63 are provided. The seven fixed blades 63 are provided at regular intervals in the peripheral direction. The fixed blades 63 couple the base portion 6 to the outer frame portion 2. As a result, the base portion 6 is fixed in the radially central part of the wind tunnel space 23.

The fixed blades 63 are provided between an inner peripheral surface of the outer frame portion 2 and an outer peripheral surface of the base portion 6. A radially outer end portion of each of the fixed blades 63 is connected to the inner peripheral surface of the outer frame portion 2. A radially inner end portion of each of the fixed blades 63 is connected to an outer peripheral surface of the round tubular portion 61 of the base portion 6. The fixed blades 63 are provided downstream in the air-blowing direction W of the rotor blades 4, in the wind tunnel space 23.

A plurality of opening portions 71 is provided in the inclined portion 62 of the base portion 6. The opening portions 71 are provided at predetermined intervals in the peripheral direction of the inclined portion 62. In the illustrated example, six opening portions 71 are provided in such a manner as to correspond to the fixed blades 63 in the peripheral direction.

Hollow ribs 72 that extend in such a manner as to stick out from the inclined portion 62 are respectively provided to peripheral parts of the opening portions 71. Each of the hollow ribs 72 is provided in such a manner as to surround a radially outer side, that is to say, a side closer to the wind tunnel space 23, of the peripheral part of the respective opening portion 71. The hollow ribs 72 are provided in such a manner as to stick out from the inclined portion 62 toward the downstream side in the air-blowing direction W and along the rotation axis X.

Each of the hollow ribs 72 is formed in, for example, an arc shape as a peripheral wall surrounding the outer side of the peripheral part of the respective opening portion 71. Each of the hollow ribs 72 is formed as a peripheral wall that shields the respective opening portion 71 from the wind flowing in the air-blowing direction W in the wind tunnel space 23. Each of the hollow ribs 72 functions as a peripheral wall that restrains the wind flowing in the air-blowing direction W in the wind tunnel space 23 from flowing radially inward toward the respective opening portion 71. The hollow ribs 72 provided to the inclined portion 62 allow air to flow into the base portion 6 from the outside through the opening portions 71 without influencing the flow of the wind flowing in the air-blowing direction W in the wind tunnel space 23. The air that has flowed into the base portion 6 is sucked into the wind tunnel space 23 through a gap 56 between the base portion 6 and the rotor blade case 41, which are placed in such a manner as to face each other.

The opening portions 71 and the hollow ribs 72 are provided at positions separated from an end surface 64, on the downstream side in the air-blowing direction W, of the base portion 6 toward the upstream side in the air-blowing direction W. In other words, the opening portions 71 and the hollow ribs 72 of the base portion 6 are provided at positions recessed into the upstream side in the air-blowing direction W from the end surface 64 of the base portion 6.

Projection portions 73 are respectively provided inside the opening portions 71. The projection portions 73 extend radially inward from an outer peripheral wall of the base portion 6. The outer peripheral wall of the base portion 6 may be an outer peripheral wall of the round tubular portion 61 of the base portion 6. Alternatively, the outer peripheral wall of the base portion 6 may be an outer peripheral wall of the inclined portion 62 of the base portion 6. In the illustrated example, the projection portions 73 extending from the outer peripheral wall of the inclined portion 62 are provided. Each of the opening portions 71 is formed as an opening configuring a labyrinth structure with the respective projection portion 73 provided in the opening portion 71. Consequently, air can flow in while the flow of dust into the base portion 6 from the outside through the opening portion 71 is restrained.

Figure 3:
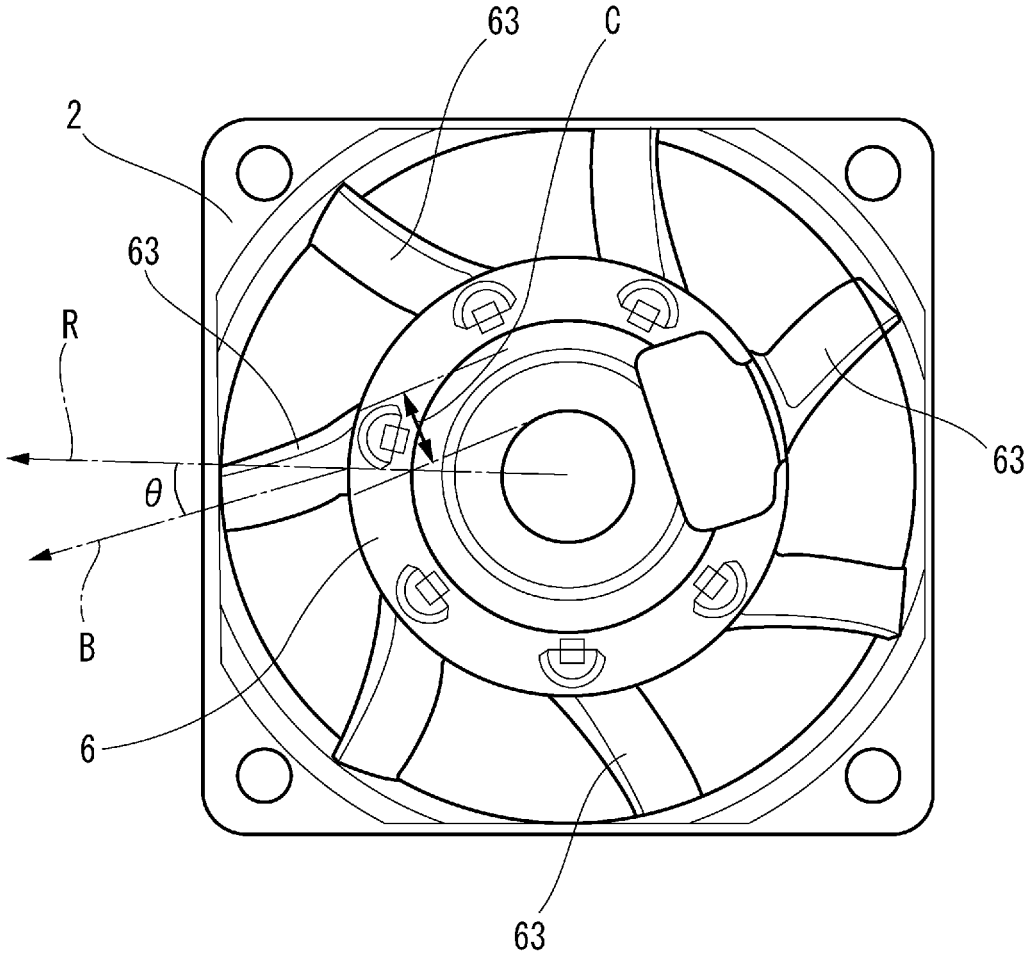
FIG. 3 is a front view of the axial fan illustrated in FIG. 1.

FIG. 3 is a front view of the axial fan 1. The positional relationships between the opening portions 71 and the hollow ribs 72, and the fixed blades 63 are described with reference to FIG. 3.

As illustrated in FIG. 3, the fixed blades 63 are thin plate-shaped members provided radially to an outer peripheral part of the base portion 6. In the illustrated example, the fixed blades 63 are each attached between the outer frame portion 2 and the base portion 6 in such a manner that a fixed blade direction B inclines by a predetermined angle θ relative to a radial direction R.

Each opening portion 71 and the respective hollow rib 72 are provided in such a manner as to be included within a peripheral region C of the inclined portion 62 continuous with the corresponding fixed blade 63 that inclines relative to the radial direction R as viewed in a direction of the rotation axis X, for example, from the front of the axial fan 1. In other words, each opening portion 71 and the respective hollow rib 72 are placed downstream of the corresponding fixed blade 63 in such a manner as to overlap with the corresponding fixed blade 63 in the air-blowing direction W. In this manner, the opening portions 71 and the hollow ribs 72 are provided in such a manner as to be shielded by the fixed blades 63 from the wind flowing in the air-blowing direction W in the wind tunnel space 23. The angle θ of the fixed blades 63 inclining relative to the radial direction R may vary according to the type of axial fan.

As described above, the axial fan 1 according to the embodiment includes the rotor blades 4 that rotate about the rotation axis X extending along the air-blowing direction W, the round tubular base portion 6 that is located on the rotation axis X and downstream in the air-blowing direction W of the rotor blades 4, and the outer frame portion 2 where the rotor blades 4 and the base portion 6 are housed. The base portion 6 includes the inclined portion 62 in the end portion, on the downstream side in the air-blowing direction W, of the base portion 6, the inclined portion 62 reducing in diameter toward the downstream side in the air-blowing direction W. The inclined portion 62 is provided with the opening portions 71 provided at the predetermined intervals in the peripheral direction, and the hollow ribs 72 that are formed in such a manner as to surround the radially outer peripheral parts of the opening portions 71, respectively, and extend in such a manner as to stick out from the inclined portion 62 toward the downstream side in the air-blowing direction W along the rotation axis X. In this manner, the opening portions 71, and the hollow ribs 72 each surrounding the periphery of the respective opening portion 71 are provided to the inclined portion 62 of the base portion 6 to enable shielding the opening portions 71 from the wind flowing in the air-blowing direction W in the wind tunnel space 23. Hence, it is possible to restrain a reduction in the volume of air/static pressure performance of the axial fan 1 that may be caused by providing the opening portions 71 in the base portion 6. Moreover, air can flow into the base portion 6 from the outside through the opening portions 71 without influencing the wind flowing in the wind tunnel space 23. Hence, it is possible to restrain an increase in the temperature of, for example, an electronic component by having, for example, a configuration that the air that has flowed into the base portion 6 hits the circuit board 55 under high load on the axial fan 1. Consequently, it is possible to reduce the amount of heat generated in the axial fan 1.

Moreover, according to the axial fan 1, each of the hollow ribs 72 is formed in an arc shape that surrounds the radially outer peripheral part of the respective opening portion 71. In this manner, the hollow ribs 72 have an arc shape. As a result, it is further possible to shield the opening portions 71 without influencing the wind flowing in the wind tunnel space 23. Hence, it is possible to restrain a reduction in the volume of air/static pressure performance of the axial fan 1.

Moreover, according to the axial fan 1, the opening portions 71 and the hollow ribs 72 are provided at the positions separated from the end surface, on the downstream side in the air-blowing direction W, of the base portion 6 toward the upstream side in the air-blowing direction W. In this manner, the opening portions 71 and the hollow ribs 72 are provided, spaced from the downstream end surface of the base portion 6. Consequently, it is possible to cause air to smoothly flow into the base portion 6 from the outside through the opening portions 71. Hence, it is possible to further restrain a reduction in the volume of air/static pressure performance.

Moreover, according to the axial fan 1, each of the opening portions 71 has a labyrinth structure therein. In this structure, the projection portion 73 extending radially inward from the outer peripheral wall of the base portion 6 is provided. In this manner, the labyrinth structure in each of the opening portions 71 allows restraining the flow of dust into the base portion 6 through the opening portion 71.

Moreover, the axial fan 1 further includes the fixed blades 63 that are provided between the inner peripheral surface of the outer frame portion 2 and the outer peripheral surface of the base portion 6 and downstream in the air-blowing direction W of the rotor blades 4. The opening portions 71 and the hollow ribs 72 are provided downstream in the air-blowing direction W of the fixed blades 63, and each provided in such a manner as to be included within the peripheral region C in the peripheral direction where the corresponding fixed blade 63 is provided as viewed in the direction of the rotation axis X. In this manner, the opening portions 71 and the hollow ribs 72 are each provided downstream in the air-blowing direction W of the corresponding fixed blade 63 in such a manner as to overlap with the corresponding fixed blade 63 as viewed in the direction of the rotation axis X. Consequently, it is possible to reduce influence on the wind flowing in the wind tunnel space 23 and to further restrain a reduction in the volume of air/static pressure performance.

Up to this point the embodiment of the present disclosure has been described. However, it is needless to say that the technical scope of the embodiment should not be construed in a limited manner by the above-mentioned detailed description. The above-mentioned embodiment is a mere example. Those skilled in the art understand that the embodiment can be modified in various manners within the technical scope described in the claims. The technical scope of the embodiment should be determined on the basis of the technical scope described in the claims and the scope of equivalents thereof.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An axial fan comprising:

a rotor blade configured to rotate about a rotation axis along an air-blowing direction;

a round tubular base portion placed on the rotation axis and on a downstream side in the air-blowing direction of the rotor blade; and an outer frame portion where the rotor blade and the base portion are housed, wherein the base portion includes an inclined portion in an end portion, on the downstream side in the air-blowing direction, of the base portion, the inclined portion reducing in diameter toward the downstream side in the air-blowing direction, the inclined portion includes opening portions and hollow ribs, the opening portions are placed at predetermined intervals in a peripheral direction of the inclined portion, and each of the hollow ribs surrounds a peripheral part on an outer side of each of the opening portions in a radial direction of the inclined portion, and sticks out from the inclined portion toward the downstream side in the air-blowing direction along the rotation axis.

2. The axial fan according to claim 1, wherein the opening portions and the hollow ribs are placed at positions separated from an end surface, on the downstream side in the air-blowing direction, of the base portion toward an upstream side in the air-blowing direction.

3. The axial fan according to claim 1, further comprising a fixed blade placed between an inner peripheral surface of the outer frame portion and an outer peripheral surface of the base portion and on the downstream side in the air-blowing direction of the rotor blade, wherein the opening portion and the hollow rib are placed on the downstream side in the air-blowing direction of the fixed blade, and placed in such a manner as to be included within a peripheral region of the inclined portion continuous with the fixed blade as viewed in a direction of the rotation axis.

4. The axial fan according to claim 1, wherein each of the hollow ribs is formed in an arc shape surrounding the peripheral part on the outer side of the respective opening portion.

5. The axial fan according to claim 1, wherein each of the opening portions has a labyrinth structure in which a projection portion is included inside the opening portion, the projection portion extending radially inward from an outer peripheral wall of the base portion.

* * * * *